US005579726A

United States Patent [19]

Finucane

[11] Patent Number: 5,579,726

[45] Date of Patent: Dec. 3, 1996

[54] APPARATUS FOR CLEANING BOILERS

[76] Inventor: Louis Finucane, 10791 Ravenna Rd., Twinsburg, Ohio 44087

[21] Appl. No.: 285,896

[22] Filed: Aug. 4, 1994

[51] Int. Cl.[6] ..... F22B 37/18

[52] U.S. Cl. ..... 122/379; 122/381; 122/382; 122/391; 122/392; 165/95; 15/316.1; 15/317; 15/318; 15/318.1

[58] Field of Search ..... 122/391, 392, 122/381, 382; 15/316.1, 317, 318, 318.1; 165/95

[56] References Cited

U.S. PATENT DOCUMENTS

| | | | |
|---|---|---|---|
| Re. 32,517 | 10/1987 | Nelson . | |
| 1,676,019 | 7/1928 | Girtanner et al. | 122/379 |
| 3,785,351 | 1/1974 | Hall | 122/379 |
| 4,503,811 | 3/1985 | Hammond . | |
| 4,527,515 | 7/1985 | Hester, II . | |
| 4,603,661 | 8/1986 | Nelson et al. . | |
| 4,690,159 | 9/1987 | Vadakin et al. . | |
| 4,827,953 | 5/1989 | Lee | 134/172 |
| 4,850,423 | 7/1989 | Allen et al. . | |
| 4,945,862 | 8/1990 | Vadakin | 122/392 |
| 5,007,970 | 4/1991 | Herrmann et al. . | |
| 5,129,455 | 7/1992 | Boisture . | |
| 5,237,718 | 8/1993 | Brown | 15/318.1 |

*Primary Examiner*—Henry A. Bennett
*Assistant Examiner*—Siddmarth Ohri
*Attorney, Agent, or Firm*—Fay Sharpe Beall Fagan Minnich & McKee

[57] ABSTRACT

A device for cleaning a combustion device such as a boiler coincidentally with operation of the boiler. The apparatus comprises a means for rotation of a lance and rotatable cleaning head attached to the lance. The lance also moves in a linear direction and out of a combustion chamber. The invention requires the presence of the linear and rotational driving mechanism exterior to the boiler to allow operation of the device while the combustion chamber is at high temperature. During operation, a high pressure water jet is expelled from the nozzles of the rotatable cleaning apparatus at greater than 10,000 psi. A microprocessor controls the system to allow a repeatable, consistent, and tailored cleaning of the internal components of a combustion device.

19 Claims, 4 Drawing Sheets

APPARATUS FOR CLEANING BOILERS

BACKGROUND OF THE INVENTION

This invention is directed to the removal of matter such as slag and sludge which collects on heated surfaces within boilers and other steam generation equipment. Particularly, this invention relates to an apparatus that automatically and controllably removes ash, slag, sludge and other undesirable build-up in fired and/or unfired boilers. Heated surfaces contemplated within the scope of this invention are various components of a boiler including but not limited to the heat exchange tubes, cyclone burner, air preheater and evaporator.

The apparatus of the invention is particularly well-suited for automatically removing slag build-up in waste to energy facilities while the facility is on-line, i.e. in a fired condition.

DESCRIPTION OF THE ART

Build-up of combustion and/or steam residue within boilers, including those based on fossil fuel, nuclear energy and waste, interferes with heat transfer efficiencies, air flow, burn rates, and generally adversely effects the operation of the boiler. Particularly, a significant slag build-up occurs on the heated surfaces of the boilers. This accumulation of slag lowers energy transfer and electricity production is reduced. Slag may also result in damage to the heat exchanger tube bundles. Accordingly, boilers require periodic maintenance to remove the undesirable combustion residue.

In the cleaning of boilers, water has been a preferred medium for removing slag. The two primary categories of boiler cleaning are on-line and off-line. On-line is conducted while the boiler is fired and operational, in contrast, off-line cleaning is performed during a shut-down of the boiler. Although, shut-down is a periodic requirement of all boilers, time between shut-downs can be extended and efficiency improved by cleaning during the interim period. On-line cleaning therefore provides a significant commercial advantage to the facility operator.

With regard to off-line systems, an exemplary cleaning device is described in U.S. Pat. No. 4,690,159. The device includes a pair of rotary lances which deliver a high pressure cleaning fluid across the surface of the cylindrical housing of a boiler. A support cable extending across the boiler supports the device as it moves. A motor is attached to the device to rotate the lances while a high pressure cleaning fluid is expelled. Since the motor and swivel are positioned within the boiler chamber (operated in excess of 1600° F.), the apparatus is limited to use when the boiler is off-line. In addition, the relative expansion rates of the mounting shaft and the cables would make sliding along the cable very impractical at elevated temperatures. As stated above, this is a significant drawback because efficiencies and commercial interests favor on-line cleaning.

As an alternative, an on-line cleaning technique generally referred to as soot blowing has been employed. U.S. Pat. No. Re. 32,517 describes a typical soot blowing apparatus in which a low pressure liquid, usually steam is applied to the heated surface. In this design, the thermal shock of the fluid is believed to remove the slag build-up. However, it has been found that soot blowing is often inadequate in removing slag build-up. In fact, waste to energy facilities have proven especially troublesome for soot blowers due to the increased moisture and adverse chemicals in garbage, resulting in more slag and the related plugging problems within the boiler. In addition, the increased use of low sulphur, high moisture content fossil fuels has caused similar problems in conventional fossil fuel power plants.

Typically, to compensate for the inefficiencies of soot blowers, contractors are retained to manually clean the boilers. Manual cleaning can be performed on-line or off-line. During on-line cleaning, access doors to the boiler are opened to provide introduction of a high pressure cleaning lance. This activity is often dangerous because the boiler may go positive in a plugged area, causing a hot gas discharge onto the individual performing the cleaning. A further difficulty in manual cleaning is exposure of workers to lead, mercury, etc., often found in high concentrations within boilers. In addition to the many safety hazards, the lance often flexes and bends when it is extended, making it extremely difficult to position and/or control the advance rate. Therefore, an undesirable random cleaning pattern results with no ability to assuredly clean the most problematic areas.

Accordingly, it would be desirable in this art to have an apparatus capable of safe, repeatable and effective on-line cleaning of slag in boilers.

SUMMARY OF THE INVENTION

A primary advantage of this apparatus is its ability for on-line, controllable, repeatable, and consistent cleaning of boilers.

Additional advantages of the invention will be set forth in part in the description which follows and in part will be obvious from the description or may be learned by practicing the invention. The objects and the advantages of the invention may be realized and attained by means and the instrumentalities and combinations particularly pointed out in the appended claims.

To achieve the foregoing objects and in accordance with the purpose of the invention, as embodied and broadly described herein, the apparatus of this invention comprises a cylindrical shaft having an axial bore and a rotatable cleaning device attached to one end of the shaft. The cleaning device includes a passage in fluid communication with the bore of the shaft and at least one nozzle in fluid communication with the passage for expelling a high pressure cleaning fluid introduced through the bore in the shaft. Preferably, the shaft is surrounded by a sheath for at least a portion of its length.

An apparatus positioned remotely to the high temperature area of a heated reaction device being cleaned imparts a linear motion to the shaft and the rotatable cleaning device. Accordingly, the cleaning device can be extended and retracted in a linear direction within the high temperature area of the device. The rotation of the cleaning device is achieved by either an apparatus rotating the shaft and cleaning device or by designing the cleaning device with offset nozzles resulting in rotation when the high pressure fluid is discharged. An apparatus located remotely to the high temperature area supplies a high pressure cleaning fluid to the bore of the cylindrical shaft, preferably via a swivel, also isolated from the high temperature area, yet in fluid communication with the rotating shaft. As used herein, high temperature areas include those locations in which combustion or other heat generating reaction occurs or where combustion effluents are present.

Preferably, a motor controller is utilized in conjunction with a linear motion detector to sense and control the position of the cleaning device. Preferably, the motor controller takes the form of a programmable logic controller to control movement of the apparatus and achieve more intense cleaning of those areas of the chamber known to have the greatest slag accumulation.

BRIEF DESCRIPTION OF THE DRAWINGS

The invention consists in the novel parts, construction, arrangements, combinations, and improvements shown and described. The accompanying drawings, which are incorporated in and constitute a part of the specification illustrate one embodiment of the invention and, together with the description, serve to explain the principles of the invention. Of the drawings.

DETAILED DESCRIPTION OF THE INVENTION

Reference will now be made in detail to the presently preferred embodiment of the invention, an example of which is illustrated in the accompanying drawings.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined by the appended claims.

Figure 1:
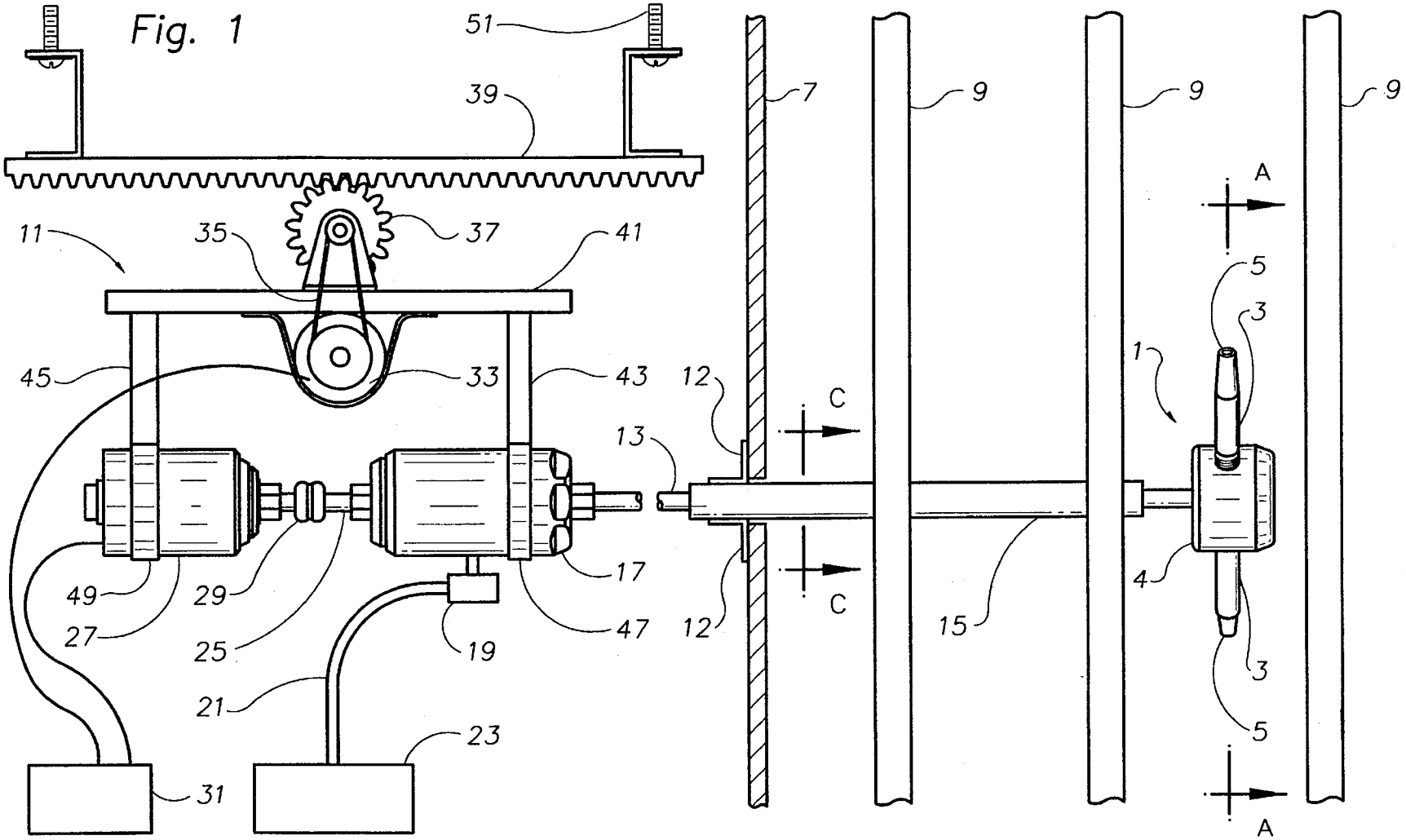
FIG. 1 is a side elevation view of the invention in relation to a cross-section of a boiler combustion chamber to be cleaned.

Referring now to FIG. 1, it can be seen that the apparatus comprises a rotatable cleaning head 1 having two nozzles 3 extending from a rotating body 4. Each nozzle is seen to terminate in a jet 5. In a preferred embodiment, the nozzles and jets are comprised of tungsten carbide, capable of operation at temperatures in excess of 1600° F., and are rated for operating pressures of at least 15,000 psi. In a further preferred embodiment, the jets are a 0° jet to achieve maximum impact upon the slag. Furthermore, the cleaning head is preferably tailored to the individual boiler. For example, a nipple may be added to the nozzle to extend it's length, bringing it closer to the slag deposits.

Again referring to FIG. 1, the cleaning head 1 is positioned within a boiler, only a section of which is shown, having a wall 7 and vertically extending heat exchanger tubes 9. A support scaffolding 51 and motion inducing mechanism 11 are located outside the boiler 7 and connected to cleaning head 1 via a lance 13. The sheath 15 translates through the boiler wall 7 and is supported by a beating mechanism 12 at the point of entry. Preferably, the sheath extends over at least 90% of the length of lance 13. Preferably, the lance 13 and sheath 15 are composed of a temperature resistant hardened steel or high temperature alloy. Stainless steel is particularly preferred due to its corrosion resistance.

One particular advantage of the current invention is the ability to use current soot blower piping as the sheath. Moreover, the lance of the current invention can be positioned within the soot blower steam/air pipe. Since the soot blowers are generally in the appropriate locations, i.e. where slag build-up is heavy, and may be equipped with motion control systems, retooling of boilers with the current invention is commercially appealing. Particularly, the sheath 15 is coded by either a flow of steam or compressed air introduced to the sheath/blower pipe 15 from the exterior of boiler 7. The sheath/blower pipe 15 is sealed at both ends when an existing soot blower pipe is utilized, the lance 13 protruding through at both ends.

Figure 5:
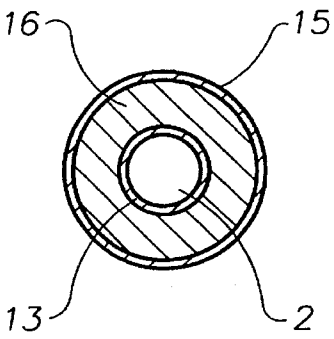
FIG. 5 is a cross-section of the rotating lance and support sheath taken along line B—B of FIG. 1.

Referring again to FIG. 1, lance 13 having a bore as shown in FIG. 5 is in mechanical and fluid connection with a swivel 17. The swivel, a version of which is available from Stone Age, Inc., 54 Gerard Street, Durango, Colo. 81302, allows a high pressure fluid to enter the bore of lance 13 without twisting of hose 21. A preferred swivel will have a viscous braking arrangement and be rated for at least 200 rpm at 15,000 psi. Valve 19, supply hose 21, and fluid storage/pressurization unit 23 combine to supply the pressurized fluid to swivel 17, while swivel 17 allows introduction of the high pressure fluid at a rotational stationary point into the bore of the lance, allowing rotation of the lance to be imparted via drive shaft 25 rotated by motor 27. Water is a preferred cleaning fluid and is discharged under a system pressure of at least 3,000 psi and preferably 10,000 psi, and more preferably, at least 12,000 psi. Preferably, valve 19 incorporates a secondary annular swivel (not shown) to allow movement of hose 21. Drive shaft 25 is connected to motor 27 via coupling 29. Accordingly, motor 27 having a power source 31, imparts a rotational motion to drive shaft 27 which in turn rotates a portion of swivel 17 which communicates such rotational motion to lance 13 and hence to cleaning device 1. Preferably, the cleaning head rotates at between 0 and about 200 rpm.

Apparatus 11 also includes a device to apply linear movement to cleaning head 1. The linear drive device and swivel mechanisms are interconnected via a frame having a horizontal leg 41, vertical legs 43 and 45, connected via straps 47 and 49 to swivel 17 and motor 27, respectively. Motor 33 powered by a power source 31 rotates a chain or belt drive 35 linked to a gear 37 and linear gear track 39 to provide linear motion to the cleaning apparatus, i.e. in and out of the boiler. In an alternative design, a chain drive or rack and pinion drive is utilized.

Figure 3:
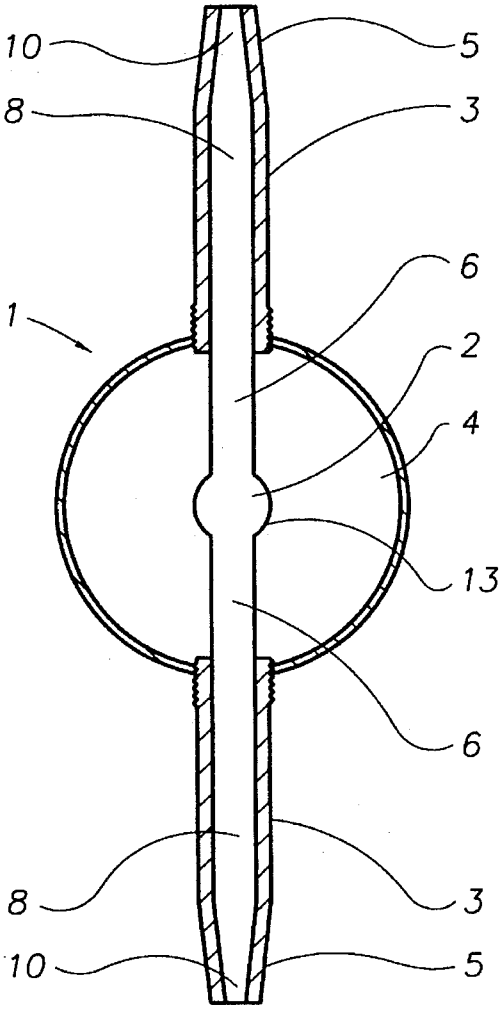
FIG. 3 is a cross-section of the rotary cleaning head taken along lines A—A of FIG. 1.

Referring now to FIG. 3, cross-section A—A of FIG. 1, demonstrates the cleaning fluid passageways of cleaning device 1 consisting of bore 2 in lance 13 encased by housing 4. Bore 13 is in fluid connection with passageways 6 leading to nozzles 3 themselves having fluid passageways 8 leading to jets 5 having venturi style fluid passageways 10.

Figure 2:
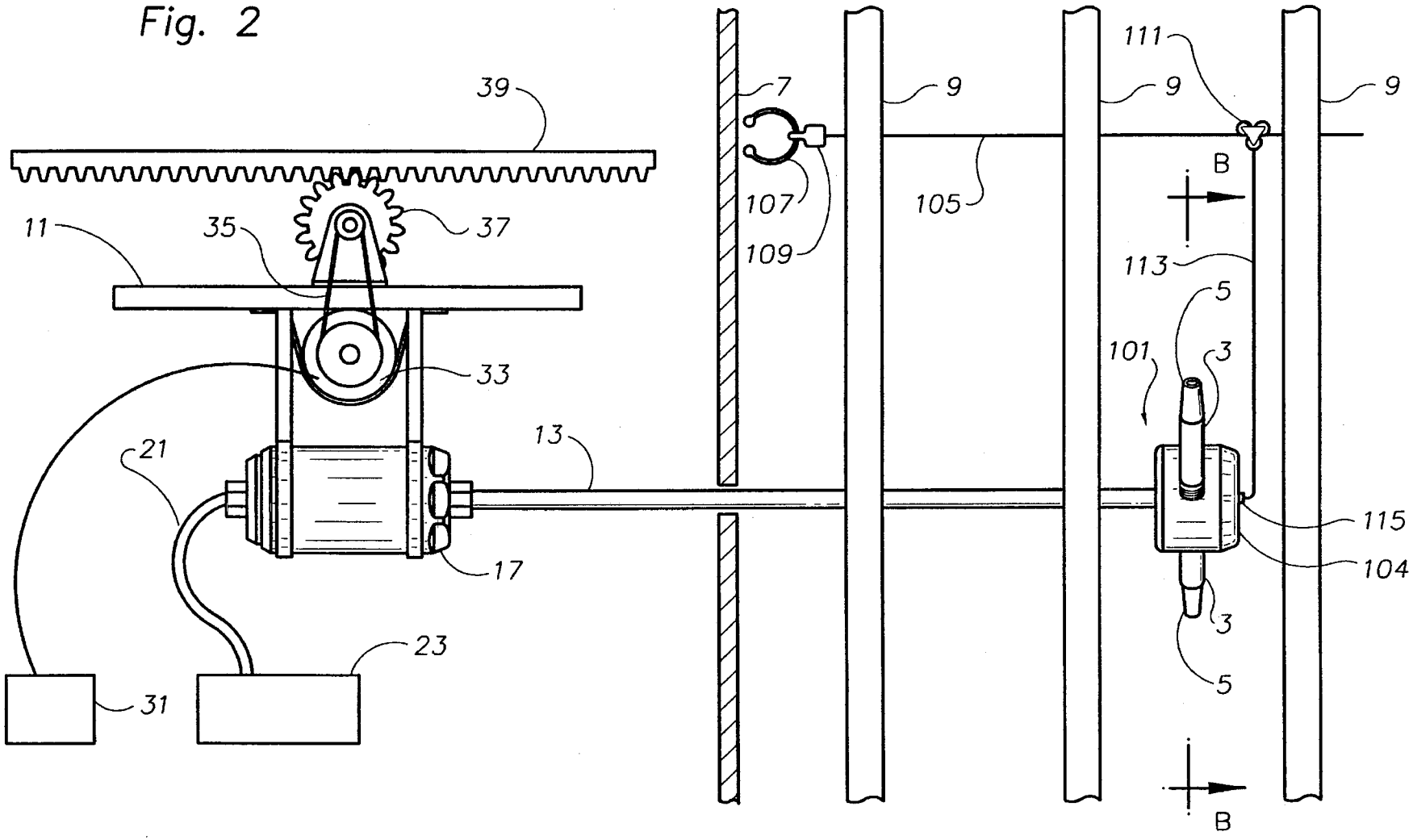
FIG. 2 is a side elevation view of an alternative embodiment of the invention in relation to a cross-section of a boiler combustion chamber.

Referring now to FIG. 2, an alternative embodiment of the invention is demonstrated. In this embodiment, items duplicated from FIG. 1 are numbered coincidentally. In this embodiment, cleaning head 101 comprises a body 104 connected to two nozzles 3 terminating in jets 5. In this embodiment and as more clearly shown in FIG. 4, nozzles 3 are threadedly connected asymmetrically on housing 104. Accordingly, the discharge of a high pressure fluid from the jets provide collaborating forces on housing 104 resulting in rotation of the jets/nozzles 3/5 and lance 13. Lance 13 is again in fluid communication with swivel 117, also in fluid connection with fluid source/pressurization device 23. As is apparent, no rotational motor is included in that the offset nozzles 3 impart the rotational momentum to the cleaning device 101. This embodiment nonetheless includes a frame 111 and linear drive mechanism including motor 33, drive chain 35, gear 37, and linear gear track 39. Power source 31 supplies energy to motor 33.

As is apparent, if a sheath is not employed, a support mechanism comprised of a cable 105 extending across the boiler 7 and secured to the walls thereof according to any means known to those of ordinary skill in the art can be substituted. Herein, the cable is secured via a hook 107 and clasp mechanism 109. Supporting cleaning device 101 is a slidable pulley device 111 connected to a vertical cable 113 attached to a rotatable connection or cleaning device 101.

Figure 6:
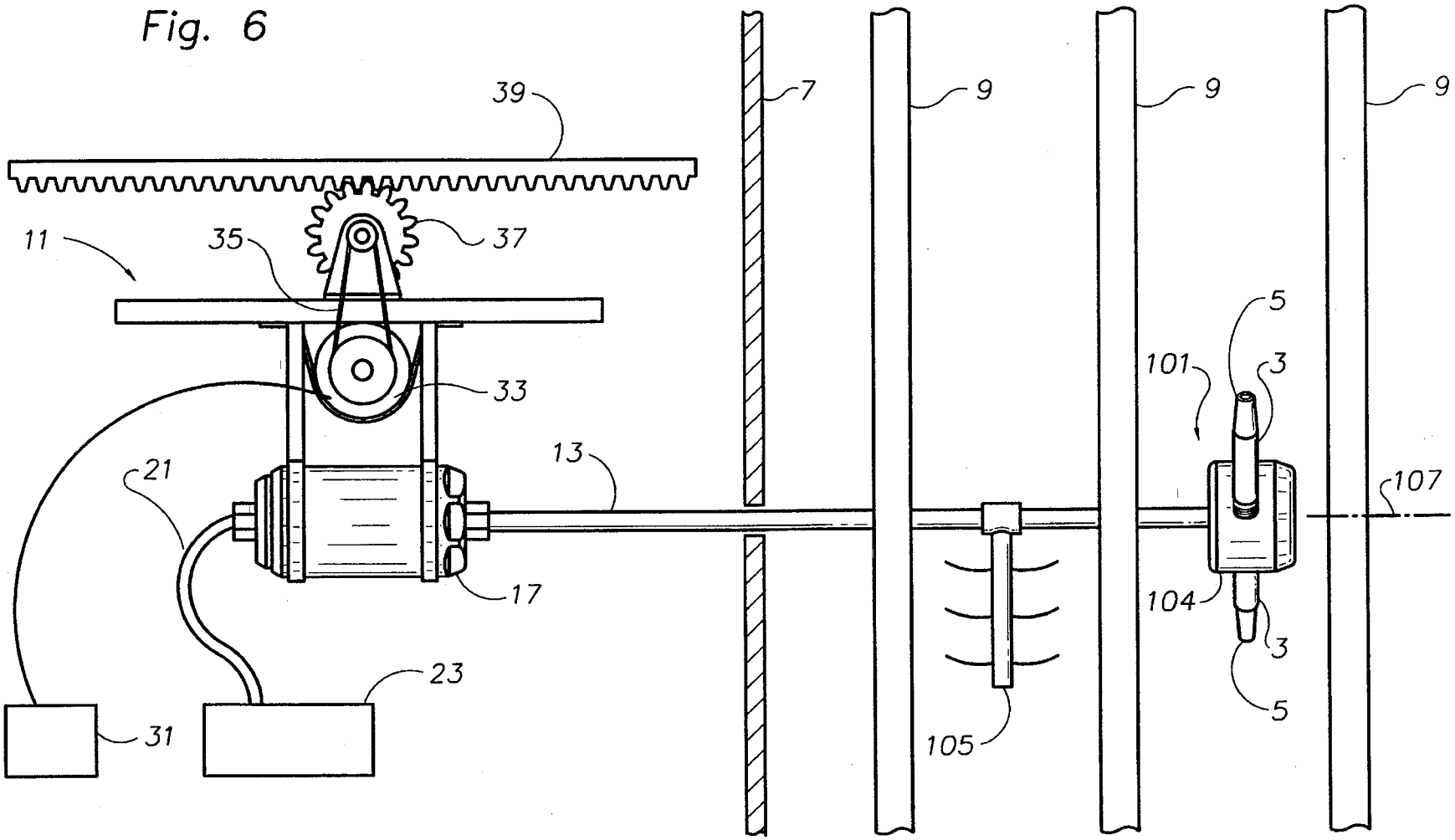
FIG. 6 is a side elevation view of an alternative embodiment of the invention.

In a more preferred alternative, FIG. 6 shows a support mechanism comprised of a series of heat-resistant brackets 105 spaced at appropriate lengths and permanently positioned across the inside of boiler 7. The brackets are located below the axis of travel 107 of lance 13 by a distance suitable to allow translation of lance 13 across the boiler 7 while minimizing deflection of cleaning device 101. The brackets can be secured to the boiler by any means known to those skilled in the art.

Figure 4:
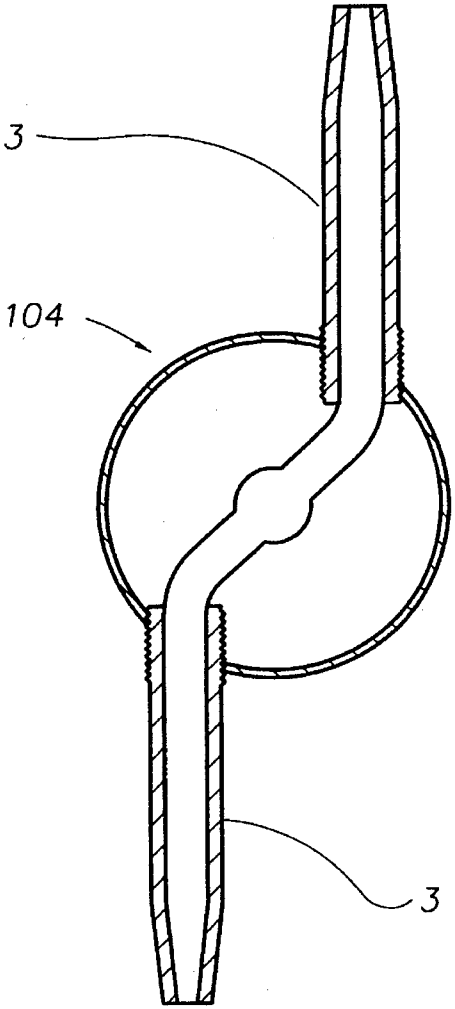
FIG. 4 is a cross-section of the rotary cleaning head taken along lines A—A of FIG. 2.

Referring now to FIG. 4, rotating cleaning device 101 of FIG. 2 is shown in cross-section along lines B—B. As shown in this embodiment, nozzles 3 are offset on housing 104. Of course, the cleaning head can be formed with three or more jets. In fact, when the boiler being cleaned has serpentine heat exchanger tubes, a three jet cleaning head is preferred.

Referring now to FIG. 5, a cross-sectional view of the lance and sheath taken along line C—C of FIG. 1 is provided. Sheath 15 surrounds lance 13 and preferably supports it via bushing 16. Bushings are positioned as needed along the length of the sheath/shaft interface and are comprised of a non-wearing material, for example, high temperature alloy steel, compatible with that of rotating lance 13.

In another preferred embodiment, a linear variable distance transducer, available from Magnetec, 650 Eary Street, Simi Valley, Calif. 93065, provides an output signal regarding the lance position within the boiler. Typically a carrier whose position is known with respect to the boiler side walls is introduced into the boiler incrementally with an oscillating translation of the carrier pipe for each pass before moving to the next pass. This allows for progressive removal of the slag between passes. Preferably, these motions are controlled and preset in a microprocessor. The microprocessor may be located remotely with respect to the lancing device. Its function is to allow selective cleaning of certain sections of the boiler according to slag build-up patterns known to predominate. The microprocessor also serves the function of automatically retracting the lance if it is determined that the nozzle head is not rotating. The linear variable distance transducer previously mentioned provides the necessary input to the microprocessor to make this determination. The microprocessor can optionally be utilized to also send a signal to the high pressure water pump. The microprocessor may also be used to monitor the inlet pressure to the high pressure swivel using the output signal from an in-line pressure sensor. Accordingly, process logic can prevent the lance from being projected into repeated passes without achieving a preset minimum operating pressure. If water pressure falls below its minimum for any reason, the lance can be automatically retracted from the boiler without the necessity of completing the cleaning cycle.

Thus, it is apparent that there has been provided, in accordance with the invention, a boiler cleaning apparatus that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for cleaning the process residue from a potentially heated reaction device comprising:

(a) a cylindrical shaft having an axial bore;

(b) a rotatable cleaning apparatus extending from one end of said shaft having a passage in fluid communication with said bore and at least one nozzle in fluid communication with said passage;

(c) an apparatus positioned remotely to a potentially high temperature area of said reaction device to rotate said cylindrical shaft and coincidentally said cleaning apparatus positioned in said potentially high temperature area;

(d) linear distance transducer to determine the position of said rotatable cleaning apparatus within said reaction device;

(e) a device to supply a cleaning fluid to said bore in said cylindrical shaft, said cleaning fluid supplied at a pressure of at least 3,000 psi; and (f) an apparatus for moving said shaft in a linear direction;

(g) said apparatus for cleaning being operable when said reaction device is fired and unfired.

2. The apparatus of claim 1 wherein said fluid is water.

3. The apparatus of claim 1 wherein said apparatus for moving said shaft in a linear direction comprises a motor.

4. The apparatus of claim 3 wherein a swivel connects said motor to said shaft.

5. The apparatus of claim 3 further comprising a microprocessor and a motor controller to provide a repeatable and consistent pattern of linear and rotational movement.

6. The apparatus of claim 1 further comprising a rotatable cleaning apparatus having three nozzles.

7. The apparatus of claim 1 wherein a sheath encases at least a portion of said shaft.

8. The apparatus of claim 1 wherein said high temperature area is at least 1,600° F.

9. The apparatus of claim 1 wherein said reaction device is selected from the group consisting of a waste to energy boiler, a fossil fuel boiler, and a chemical processing plant.

10. The apparatus of claim 9 wherein said fossil fuel is selected from the group consisting of wood, coal, oil, black liquor and gas.

11. An apparatus for cleaning the process residue from a potentially heated reaction device comprising:

(a) a cylindrical shaft having an axial bore;

(b) a rotatable cleaning apparatus extending from one end of said shaft having a passage in fluid communication with said bore and at least two nozzles asymmetrically positioned on a body surrounding said passage, said nozzles in fluid communication with said passage;

(c) a device to supply a cleaning fluid to said bore in said cylindrical shaft at a pressure of at least 3,000 psi;

(d) an apparatus for moving said lance in a linear direction; and (e) a linear distance transducer to determine the position is at a rotatable cleaning apparatus within said reaction device;

(f) said apparatus for cleaning being operable when said heated reaction device is fired and unfired.

12. The apparatus of claim 11 wherein said apparatus for moving said lance comprises a motor.

13. The apparatus of claim 12 further comprising a microprocessor and motor controller to provide a repeatable and consistent pattern of linear movement.

14. The apparatus of claim 11 wherein said fluid is water.

15. The apparatus of claim 11 wherein a sheath encases at least a portion of said lance.

16. The apparatus of claim 1 wherein brackets support said shaft within said reaction device.

17. The apparatus of claim 11 wherein brackets support said shaft within said reaction device.

18. The apparatus of claim 12 wherein a swivel connects said motor to said shaft.

19. The process of claim 17 wherein said pressure is greater than 10,000 psi.

* * * * *